US007545090B2

(12) United States Patent
Han et al.

(10) Patent No.: US 7,545,090 B2
(45) Date of Patent: Jun. 9, 2009

(54) DESIGN FOR A FIELD EMISSION DISPLAY WITH CATHODE AND FOCUS ELECTRODES ON A SAME LEVEL

(75) Inventors: In-Taek Han, Seoul (KR); Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 537 days.

(21) Appl. No.: 10/995,430

(22) Filed: Nov. 24, 2004

(65) Prior Publication Data

US 2005/0110393 A1 May 26, 2005

(30) Foreign Application Priority Data

Nov. 25, 2003 (KR) ..... 10-2003-0084180

(51) Int. Cl.
*H01J 1/62* (2006.01)
*H01J 1/304* (2006.01)
*H01J 63/04* (2006.01)

(52) U.S. Cl. ..... 313/495; 313/496; 313/497; 313/308; 313/304

(58) Field of Classification Search ..... 313/495–497, 313/306, 309–310
See application file for complete search history.

(56) References Cited

U.S. PATENT DOCUMENTS 5,708,327 A * 1/1998 O'Boyle ..... 313/495
5,859,493 A * 1/1999 Kim ..... 313/309
6,900,586 B2 * 5/2005 Moradi et al. ..... 313/495
6,917,155 B1 * 7/2005 Kamide et al. ..... 313/495
7,259,511 B2 * 8/2007 Yaguchi et al. ..... 313/497
2002/0031972 A1 * 3/2002 Kitamura et al. ..... 445/3
2004/0066132 A1 * 4/2004 Cho et al. ..... 313/495
2004/0119396 A1 * 6/2004 Lee et al. ..... 313/495
2006/0197435 A1 * 9/2006 Okai et al. ..... 313/496

FOREIGN PATENT DOCUMENTS

JP 2003016918 A * 1/2003
JP 2003100200 A * 4/2003

OTHER PUBLICATIONS

Machine English translation of JP 2003100200A to Nomura.*

* cited by examiner

*Primary Examiner*—Sikha Roy
(74) *Attorney, Agent, or Firm*—Robert E. Bushnell, Esq.

(57) ABSTRACT

A novel field emission display (FED) and a novel method for making the same. The FED includes a substrate, a cathode electrode and a focus electrode formed on the same level with each other on the substrate, an insulation layer formed on the cathode electrode and the focus electrode such that the cathode electrode and the focus electrode are partially exposed through the insulation layer, a field emitter formed at the cathode electrode exposed by the insulation layer, and a gate electrode formed on the insulation layer. The field emitter being formed on the same layer and of the same material and at the same time as the cathode electrode.

15 Claims, 16 Drawing Sheets

DESIGN FOR A FIELD EMISSION DISPLAY WITH CATHODE AND FOCUS ELECTRODES ON A SAME LEVEL

CLAIM OF PRIORITY

This application makes reference to, incorporates the same herein, and claims all benefits accruing under 35 U.S.C. §119 from an application for FIELD EMISSION DISPLAY AND METHOD OF MANUFACTURING THE SAME earlier filed in the Korean Intellectual Property Office on 25 Nov. 2003 and there duly assigned Serial No. 2003-84180.

BACKGROUND OF THE INVENTION

1. Field of the Invention

The present invention relates to a field emission display (FED) and a method of manufacturing the same, and more particularly, to an FED that can efficiently focus electron beams and a method of manufacturing the same.

2. Description of the Related Art

Display devices, which account for one of the most important parts of conventional data transmitting media, have been used in personal computers and television receivers. The display devices include cathode ray tubes (CRTs), which use high-speed heat electron emission, and flat panel displays, such as liquid crystal displays (LCDs), plasma display panel (PDPs), and field emission displays (FEDs), which have been rapidly developing in recent years.

Of these flat panel displays, an FED is a display device that enables electrons to be emitted from a field emitter arranged at regular intervals on a cathode electrode by forming a strong electric field between the field emitter and a gate electrode and radiating light by colliding the electrons with a fluorescent material of an anode electrode. The FED, which is a very thin display device having a thickness of only several centimeters, has many advantages, such as a wide angle of vision, low power consumption, and low manufacturing costs. This is why the FED has long been considered as one of the most prominent next generation display devices, together with an LCD and a PDP.

The FED takes advantage of almost the same physical principle as a CRT. That is, a light beam having a predetermined color is radiated from a fluorescent material coated on an anode electrode when electrons emitted from a cathode electrode are accelerated toward and collide with the anode electrode. However, there is a distinctive difference between the FED and the CRT in that an emitter of the FED, unlike an emitter of the CRT, is formed of a cold cathode material.

In an FED, the electron beam must be oriented so that it lands in the correct place, in the correct pixel where there is an anode and a phosphor layer. In order to direct the trajectory of the beam in the right direction, a separate electrode is employed. The problem is that when such a focusing electrode is incorporated into the design of the FED, separate layers need to be produced. This is very costly from a manufacturing standpoint and thus such added process steps are a drawback. If the focusing electrode is on a same level as a gate electrode, the electric fields of these two electrodes interact in a negative way. Therefore, what is needed is a design for an FED where a focusing electrode is incorporated into the design in such a way so as not to add extra process steps while being effective in controlling the direction of a trajectory of an electron beam.

SUMMARY OF THE INVENTION

It is therefore an object of the present invention to provide an improved design for an FED.

It is also an object of the present invention to provide a method for making the novel FED.

It is further an object to provide a design for an FED that properly focuses electron beams while not resulting in excess process steps.

These and other objects can be achieved by an FED that is manufactured by forming a cathode electrode on the same level as the focus electrode and a method of manufacturing the FED. The FED has a simple structure so that it is easy to manufacture the FED. In addition, the FED has enhanced focusing characteristics of electron beams.

According to an aspect of the present invention, there is provided a field emission display (FED). The FED includes a substrate, a cathode electrode and a focus electrode formed on the same level with each other on the substrate, an insulation layer formed on the cathode electrode and the focus electrode such that the cathode electrode and the focus electrode are partially exposed through the insulation layer, a field emitter formed at the cathode electrode exposed by the insulation layer, and a gate electrode formed on the insulation layer.

The cathode electrode and the focus electrode may be formed of the same material. The cathode electrode and the focus electrode may be formed simultaneously on the substrate. A plurality of cathode electrodes and a plurality of focus electrodes may be formed to be alternately arranged on the substrate. The plurality of cathode electrodes and the plurality of focus electrodes may be formed as stripes. The field emitter may be formed at one side of the cathode electrode and facing the focus electrode. The field emitter may be formed on the same level as the cathode electrode. The field emitter may be formed on one side of the cathode electrode.

The field emitter may be formed of one or a combination of the following materials: carbon nanotubes, graphite nanoparticles, nano diamond, boron nitride (BN), diamond-like carbon (DLC), cesium oxide (CsO), gold (Au), silicon (Si), platinum (Pt), iron (Fe), nickel (Ni), copper (Cu), and magnesium oxide (MgO).

The gate electrode may be formed to cross over the cathode electrode and the focus electrode. An electron extractor, which extracts electrons from the field emitter, may be formed at the gate electrode to be asymmetric with respect to the field emitter. The electron extractor may be formed extending from one side of the gate electrode. The electron extractor maybe formed on the cathode electrode.

According to another aspect of the present invention, there is provided a method of manufacturing a field emission display (FED). The method involves coating an electrode material on a substrate, forming a cathode electrode and a focus electrode on the same level with each other on the substrate by patterning the electrode material, forming a field emitter at one side of the cathode electrode that faces the focus electrode, forming an insulation layer on the cathode electrode, the focus electrode, and the field emitter, forming a gate electrode on the insulation layer, underneath which the cathode electrode and the focus electrode are located, by coating a gate electrode material on the insulation layer and patterning the gate electrode material, and partially exposing the cathode electrode, the focus electrode, and the field emitter by etching a portion of the insulation layer exposed by the gate electrode. The field emitter being formed before the application of the insulation layer.

The cathode electrode and the focus electrode may be simultaneously formed on the substrate. The cathode electrode and the focus electrode may be formed of the same material. A plurality of cathode electrodes and a plurality of focus electrodes may be formed to be alternately arranged on the substrate. The plurality of cathode electrodes and the plurality of focus electrodes may be formed as stripes.

The field emitter may be formed on the same level as the cathode electrode. The field emitter maybe formed on one side of the cathode electrode. The gate electrode maybe formed to cross over the cathode electrode and the focus electrode.

An electron extractor, which extracts electrons from the field emitter, may be formed at the gate electrode to be asymmetric with respect to the field emitter. The electron extractor may be formed extending from one side of the gate electrode. The electron extractor may be formed on the cathode electrode.

According to still another aspect of the present invention, there is provided a method of manufacturing a field emission display (FED). The method involves coating an electrode material on a substrate, forming a cathode electrode and a focus electrode on the same level as each other on the substrate by patterning the electrode material, forming an insulation layer on the cathode electrode and the focus electrode, forming a gate electrode on the insulation layer, underneath which the cathode electrode and the focus electrode are located, by coating a gate electrode material on the insulation layer and patterning the gate electrode material, partially exposing the cathode electrode and the focus electrode by etching a portion of the insulation layer exposed by the gate electrode, and forming a field emitter at an exposed portion of the cathode electrode that faces the focus electrode. An electron extractor, which extracts electrons from the field emitter, may be formed at the gate electrode to be asymmetric with respect to the field emitter. The field emitter being formed after the insulation layer is applied and etched.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
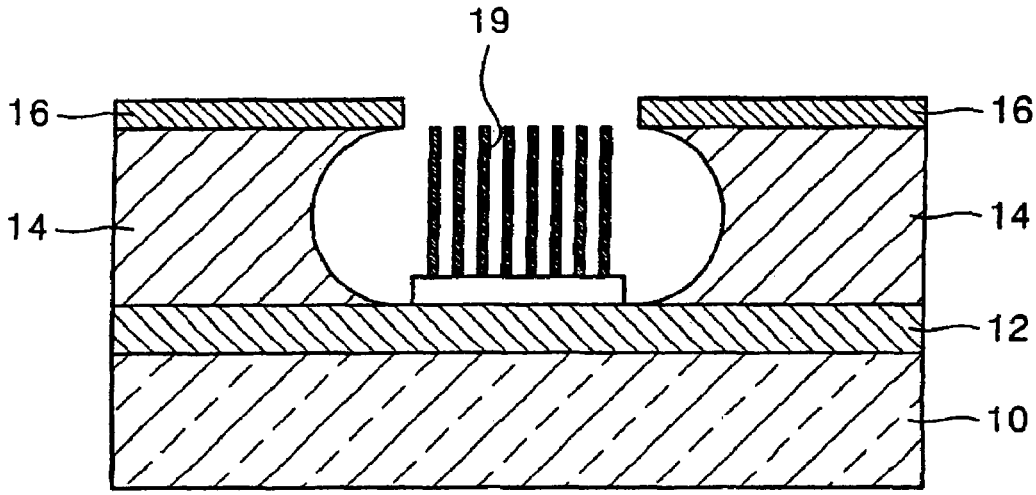
FIG. 1 is a cross-sectional view of a field emission display (FED)

Turning now to the figures, FIG. 1 illustrates the structure of an FED. Referring to FIG. 1, the FED includes a substrate 10, a cathode electrode 12 formed on the substrate 10, an insulation layer 14 formed on the cathode electrode 12, and a gate electrode 16 formed on the insulation layer 14. A field emitter 19 is located in a hole perforating the insulation layer 14, through which part of the cathode electrode 12 is exposed.

In the FED of FIG. 1, however, desired pixels cannot radiate desired colors of light beams without controlling the trajectory of an electron beam emitted from the field emitter 19. Therefore, it is necessary to precisely control the trajectory of an electron beam emitted from the field emitter so that electrons emitted from the field emitter 19 can precisely arrive at pixels where they are supposed to arrive having an anode electrode coated with a fluorescent material.

There are two different techniques of controlling the trajectory of an electron beam. In one of the two techniques, an electrode for controlling the trajectory of an electron beam and a lower substrate, on which a cathode electrode is formed, are formed separately to be a predetermined distance apart from each other. The trajectory of an electron beam is controlled by applying voltage to the electrode. Since the electrode is formed separately from the lower electrode by using a metallic mesh, it is called a remote electrode. Even though manufacturing the electrode is relatively simple because it only requires the installation of the metallic mesh, it is difficult to separate the metallic mesh from the lower substrate by a predetermined distance. It is also difficult to uniformly maintain the predetermined distance between the metallic mesh and the lower substrate, and align the metallic mesh with the lower substrate and an upper substrate in a vacuum environment.

In the other technique of controlling the trajectory of an electron beam, an electrode for controlling the trajectory of an electron beam is formed on a lower electrode, thus solving the problems with the former method of controlling the trajectory of an electron beam and enabling various shapes of electrodes to be designed in various manners.

Figure 2:
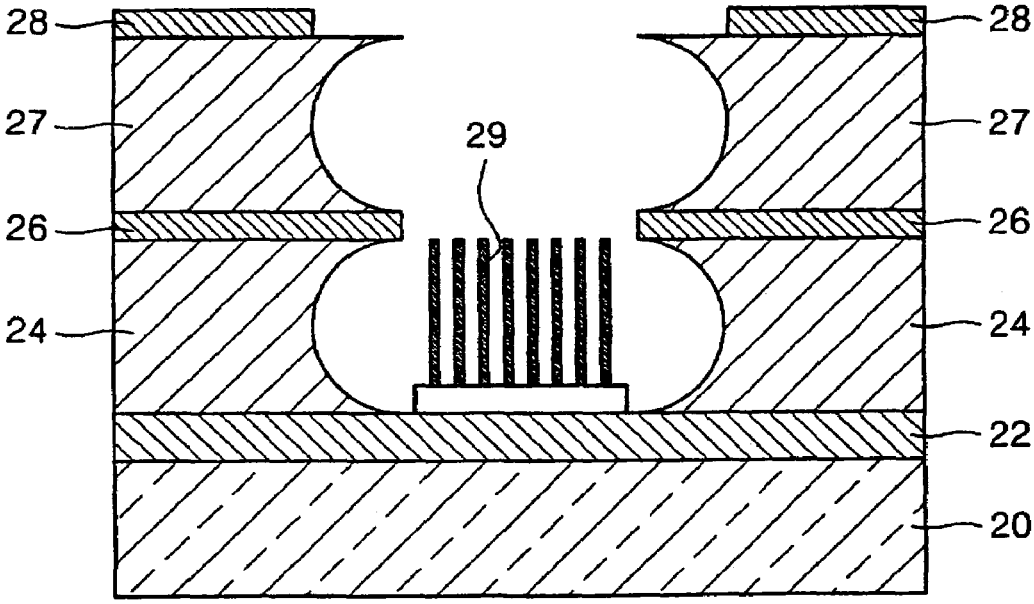
FIG. 2 is a cross-sectional view of another FED.
Figure 3:
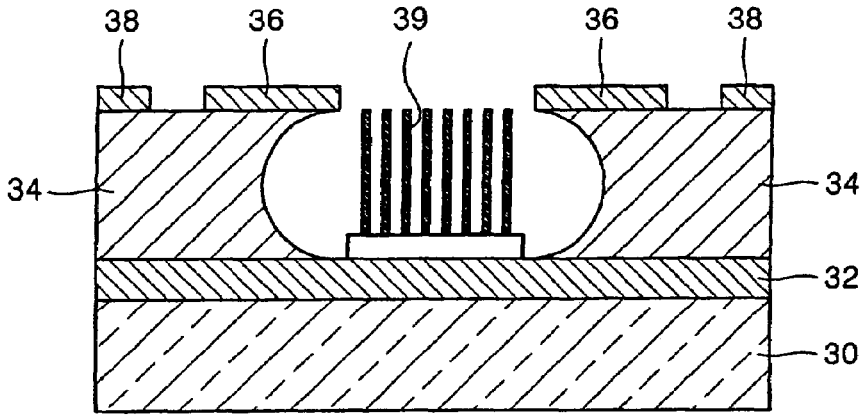
FIG. 3 is a cross-sectional view of still another FED.

There are two different methods of forming a focus electrode for controlling the trajectory of an electron beam on a lower substrate, which are respectively illustrated in FIGS. 2 and 3. In the method of forming a focus electrode 28 for controlling the trajectory of an electron beam on a lower substrate of FIG. 2, a second insulation layer 27 is deposited on a gate electrode 26, and the focus electrode 28 is formed on the second insulation layer 27. In FIG. 2, reference numerals 20, 22, 24, and 29 represent a substrate, a cathode electrode, a first insulation layer, and a field emitter, respectively. This method, however, requires additional processes of forming the second insulation layer 27 and the focus electrode 28 and at least one patterning process for forming a hole, thus generating additional expenses.

In the method of forming a focus electrode 38 for controlling the trajectory of an electron beam on a lower substrate illustrated in FIG. 3, the focus electrode 38 is formed on the same level with a gate electrode 36. In FIG. 3, reference numerals 30, 32, 34, and 39 represent a substrate, a cathode electrode, an insulation layer, and a field emitter, respectively. This method does not require additional processes of forming layers or an additional patterning process. However, it has not yet been proved whether this method can effectively focus electron beams because an electric field formed by the focus electrode 38 adversely affects an electric field formed by the gate electrode 36.

Figure 4:
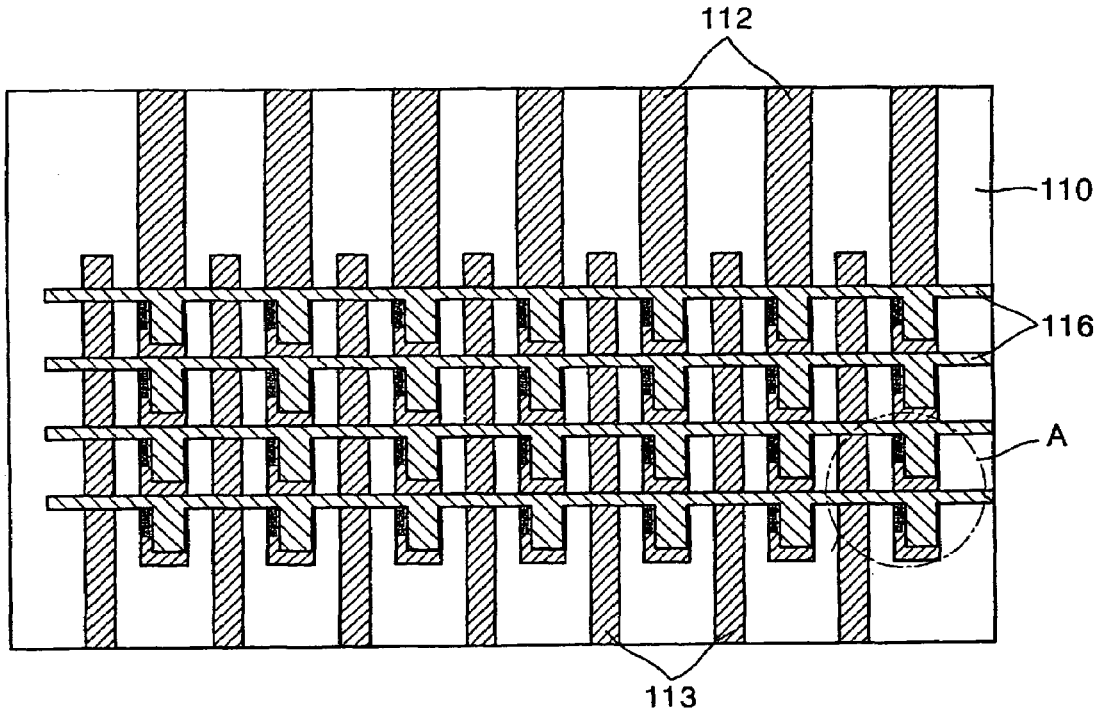
FIG. 4 is a plan view of an FED according to a preferred embodiment of the present invention.
Figure 5:
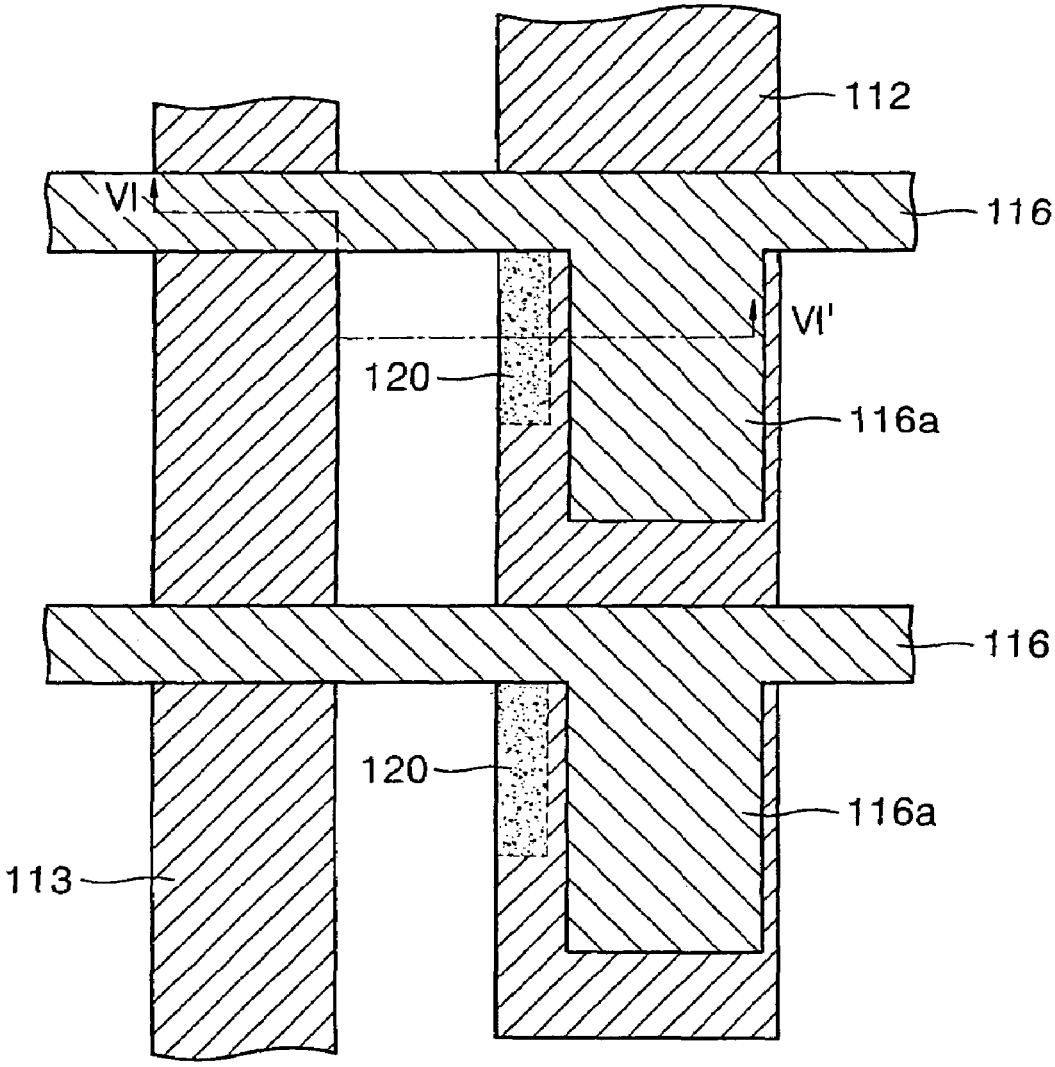
FIG. 5 is an expanded view of a portion A of FIG. 4.
Figure 6:
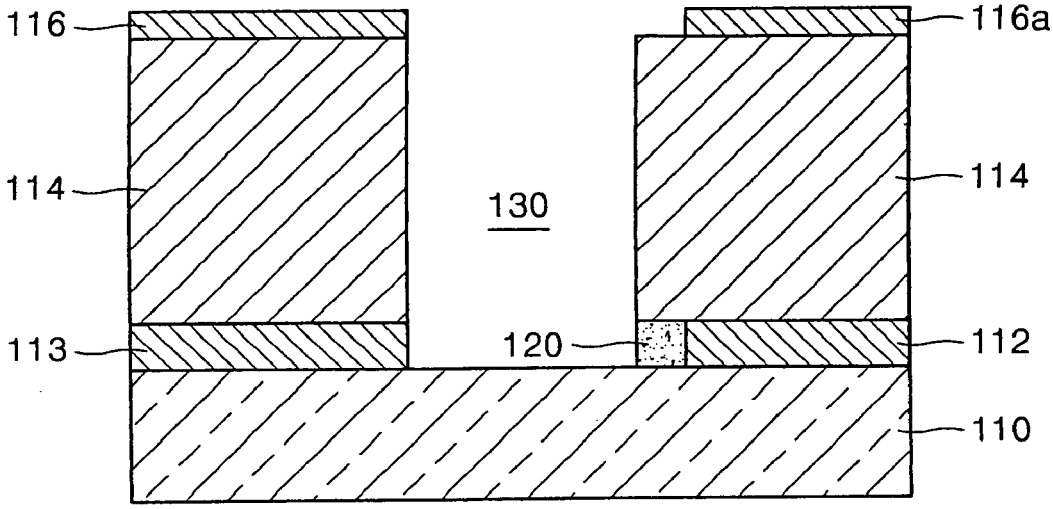
FIG. 6 is a cross-sectional view of the FED according to the preferred embodiment of the present invention, taken along line VI-VI' of FIG. 5.

Turning now to FIGS. 4 through 6, FIG. 4 is a plan view of a field emission display (FED) according to a preferred embodiment of the present invention and FIG. 5 is an expanded view of a portion A of FIG. 4, and FIG. 6 is a cross-sectional view of the FED of FIG. 4, taken along line VI-VI' of FIG. 5. Referring to FIGS. 4 through 6, the FED includes a substrate 110, cathode electrodes 112 and focus electrodes 113 formed on the same level with each other on the substrate 110, an insulation layer 114 formed on the cathode electrodes 112 and the focus electrodes 113, field emitters 120, and gate electrodes 116 formed on the insulation layer 114.

The substrate 110 is a lower substrate, on which the cathode electrodes 112 are formed, and may be a glass substrate. The cathode electrodes 112 are formed on the substrate 110 as stripes. Each of the cathode electrodes 112 maybe formed of a transparent material, such as indium tin oxide (ITO), or metal, such as chrome (Cr).

The focus electrodes 113, which are used for controlling the trajectory of an electron beam emitted from the field emitter 120, are formed on the same level with the cathode electrodes 112 on the substrate 110. The focus electrodes 113 are formed of the same material as that of the cathode electrodes, together, simultaneously with the cathode electrodes 112. The focus electrodes 113, like the cathode electrodes 112, are formed as stripes so that the cathode electrodes 112 and the focus electrodes 113 are alternately arranged on the substrate 110, as shown in FIG. 4. The cathode electrodes 112 are connected to a pad (not shown) formed at one side of the substrate 110, and the focus electrodes 113 to another pad (not shown) formed at the other side of the substrate 110. Here, the focus electrodes 113 may be connected to a common line. Therefore, it is possible to freely control the trajectory of an electron beam by varying a voltage applied to each of the focus electrodes 113.

The insulation layer 114 provides electrical insulation between the gate electrodes 116 and the cathode electrodes 112 and between the gate electrodes 116 and the focus electrodes 113. The insulation layer 114 is made of an insulation material such as silicon dioxide ($SiO_2$) to a thickness of about 5-10 μm. The thickness of the insulation layer 114 may vary depending on the material of the insulation layer 114 and how the insulation layer 114 is formed.

Emitter holes 130 are formed perforating the insulation layer 114 so that the cathode electrodes 112 and the focus electrodes 113 are partially exposed through the emitter holes 130. Sidewalls of a cathode electrode 112 and a focus electrode 113 adjacent to the cathode electrode 112 are exposed in one of the emitter holes 130.

Figure 7:
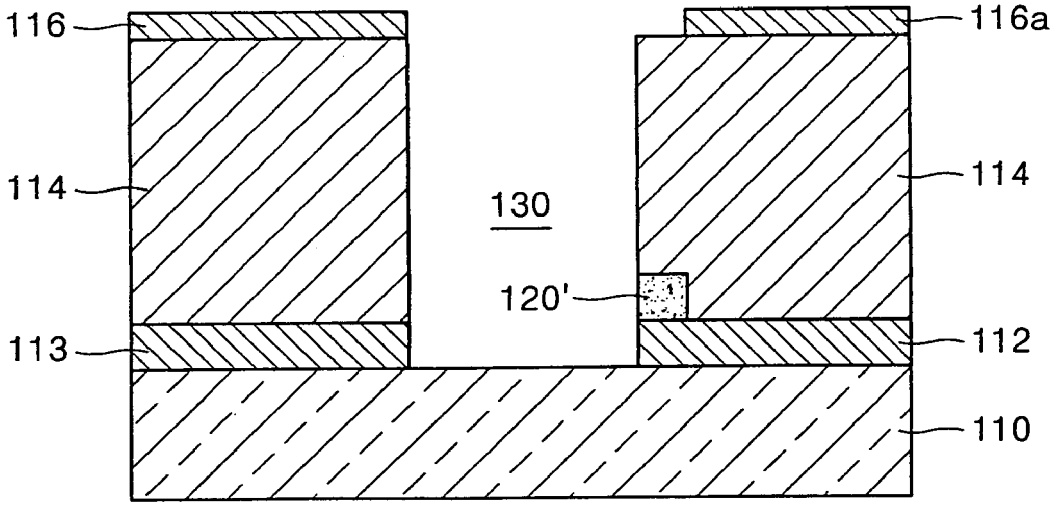
FIG. 7 is a cross-sectional view of an FED according to another preferred embodiment of the present invention.
Figure 8:
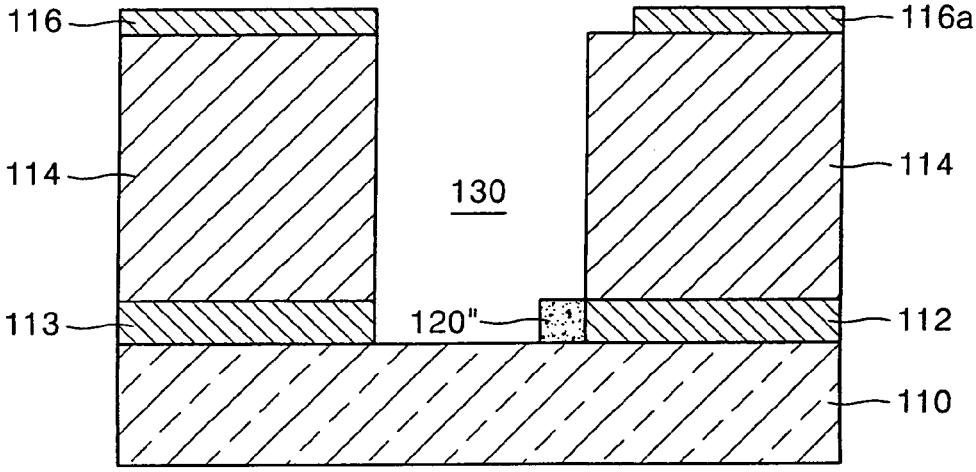
FIG. 8 is a cross-sectional view of an FED according to still another preferred embodiment of the present invention.

The field emitters 120 are formed at one sidewall of each of the cathode electrodes 112 exposed in each of the emitter holes 130. The field emitters 120 are formed on the same level as the cathode electrodes 112. The field emitters 120 are formed of an electron-emitting material in a panel shape. More specifically, the field emitters 120 may be formed of one or a combination of the following materials: carbon nanotubes (CNTs), graphite nanoparticles, nano-diamond, boron nitride (BN), diamond-like-carbon (DLC), cesium oxide (CsO), gold (Au), silicon (Si), platinum (Pt), iron (Fe), nickel (Ni), copper (Cu), and magnesium oxide (MgO). Alternatively, as shown in FIG. 7, a field emitter 120' may be formed on top of one side of each of the cathode electrodes 112 exposed in each of the emitter holes 130. Still alternatively, as shown in FIG. 8, a field emitter 120" may be formed on the same level with each of the cathode electrodes 112 each of the emitter holes 130 protruding from a sidewall of each of the cathode electrodes 112.

The gate electrodes 116 are formed on the insulation layer 114 to cross over the cathode electrodes 112 and the focus electrodes 113. The gate electrodes 116 may be formed of a conductive metal, such as chrome (Cr). Electron extractors **116*a*, which extract electrons from the field emitters 120, are respectively formed with the gate electrodes 116 to be asymmetric with respect to the field emitters 120. As shown in FIG. 5, each of the electron extractors 116*a* is preferably formed over a corresponding cathode electrode 112 to extend from one side of a corresponding gate electrode 116. The electron extractors 116*a* are respectively formed at the gate electrodes 116** to assume a comb shape.

The operation of the FED according to the preferred embodiment of the present invention will now be described. Voltage is applied to the cathode electrodes 112 and the gate electrodes 116. More specifically, negative voltage is applied to the cathode electrodes 112, and positive voltage is applied to the gate electrodes 116 so that electrons can be emitted from the field emitters 120 on the cathode electrodes 112. The emitted electrons are accelerated toward anode electrodes formed on an upper substrate, thus exciting fluorescent materials coated on the anode electrodes. The excited fluorescent materials radiate light. During these processes, electron beams go almost straight ahead from where they are emitted because they are likely to move along one of the narrowest gaps among equipotential lines of an electric field formed around them.

The arrival points of the electron beams on the fluorescent materials can be adjusted by applying different voltages to the focus electrodes 113. In other words, when negative voltage is applied to the focus electrodes 113, it pushes the electrons emitted from the field emitters 120 away from each of the focus electrodes 113 such that the arrival points of the electron beams are moved. Therefore, it is possible to make the electron beams go straight ahead from where they are emitted to the fluorescent materials with a sufficiently high current density by applying an appropriate level of negative voltage to the focus electrodes 113. In addition, since the electron extractors **116*a* are formed over the cathode electrodes 112 to be asymmetric with respect to the field emitters 120, the gate electrodes 116 can move the electrons emitted from the field emitters 120 toward the gate electrodes 116** more easily than other gate electrodes having a symmetric structure. Accordingly, the gate electrodes can more easily make the electron beams go straight ahead from where they are emitted.

When positive voltage is applied to the focus electrodes 113, the focus electrodes 113 serve as secondary gate electrodes so as to increase the amount of electrons emitted from the field emitters 120. In this case, the arrival points of the electron beams may be much distant from where the electron beams are supposed to arrive on the fluorescent materials because the electron beams are more likely to fail to go straight ahead from the field emitters 120 to the fluorescent materials. However, an FED, for which the amount of current emitted from the field emitters 120 is taken more significantly than the arrival points of the electron beams, can have better performance by applying positive voltage to the focus electrodes 113.

Figure 9A:
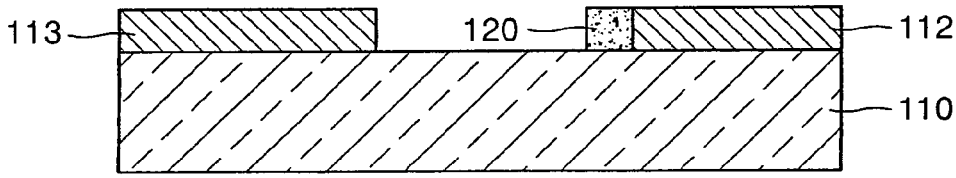
FIGS. 9A through 9D are cross-sectional views illustrating a method of manufacturing an FED according to a preferred embodiment of the present invention.

A method of manufacturing an FED according to a preferred embodiment of the present invention will now be described with reference to FIGS. 9A through 9D. Referring to FIG. 9A, a cathode electrode 112, a focus electrode 113, and a field emitter 120 are formed on a substrate 110. More specifically, an electrode material is coated on the substrate to a predetermined thickness. A glass substrate is typically used as the substrate 110, and the electrode material may be a conductive transparent material, such as ITO, or metal, such as chrome (Cr). The electrode material is patterned, thus forming the cathode electrode 112 and the focus electrode 113 on the same level with each other on the substrate 110. In short, the cathode electrode 112 and the focus electrode 113 are formed of the same material on the substrate 110 at the same time. The cathode electrode 112 and the focus electrode 113 may be formed in a predetermined pattern, for example, as stripes, in which case the cathode electrode 112 and the focus electrode 113 are alternately arranged. The patterning of the electrode material may involve forming an etching mask by coating photoresist on the substrate 110 and light-exposing and developing the photoresist and etching the electrode material using the etching mask. However, the patterning of the electrode material may also be performed in different manners from the one set forth herein.

The field emitter 120 is formed on a side of the cathode electrode 112 that faces the focus electrode 113. The field emitter 120 is formed on the same level as the cathode electrode 112. The field emitter 120 may be formed on one side of the cathode electrode 112, as shown in FIG. 7. The field emitter 120 may be formed in a plate shape, of one or a combination of the following materials: carbon nanotubes, graphite nano-particles, nano-diamond, boron nitride (BN), DLC (diamond-like carbon), cesium oxide (CsO), gold (AU), silicon (Si), platinum (Pt), iron (Fe), nickel (Ni), copper (Cu), and magnesium oxide (MgO). In the case of forming the field emitter 120 of carbon nanotubes through a chemical vapor deposition (CVD) method, a catalyst layer is coated on the substrate 110 and then patterned. The catalyst material may be formed of nickel (Ni), cobalt (Co), iron (Fe), an alloy thereof, molybdenum (Mo), or copper (Cu).

Figure 9B:
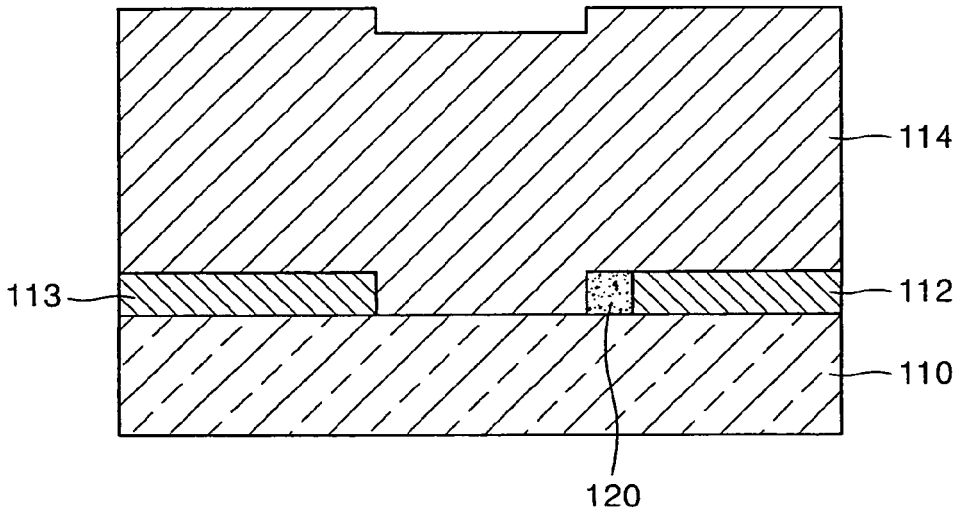

Referring to FIG. 9B, an insulation layer 114 is formed on the substrate 110, on which the cathode electrode 112, the focus electrode 113, and the field emitter 120 are formed. The insulation layer 114 is formed of an insulation material, such as silicon dioxide ($SiO_2$), to a thickness of about 5-10 μm. The thickness of the insulation layer 114 may vary depending on the material of the insulation layer 114 and how the insulation layer 114 is formed. In the case of using a thick-film forming method, the insulation layer 114 may be formed by coating a paste-type insulation material on the substrate 110 to a predetermined thickness through a screen printing method and baking the paste-type insulation material. In the case of using a thin-film forming method, the insulation layer 114 may be formed by depositing an insulation material through a CVD method.

Figure 9C:
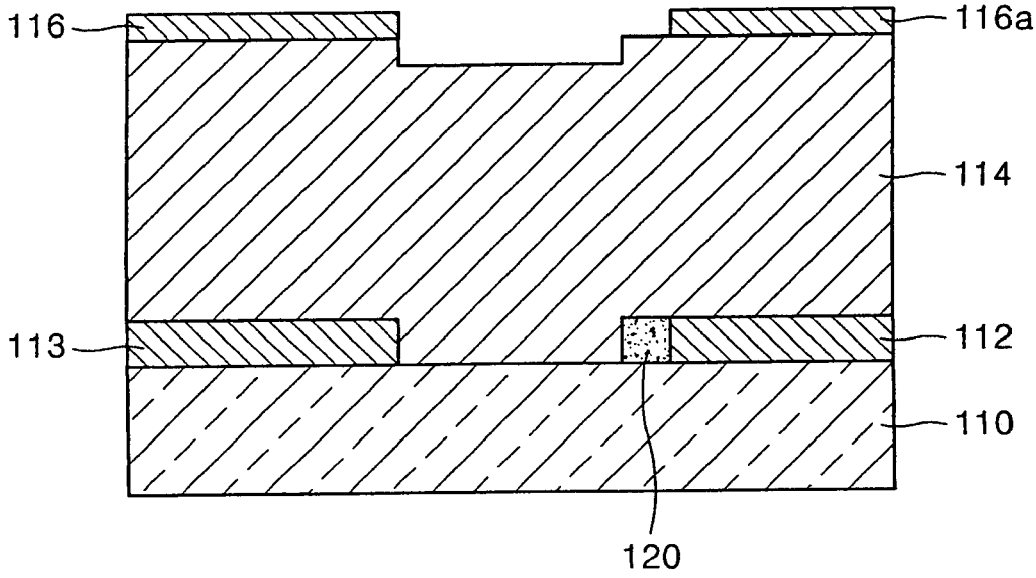

Referring to FIG. 9C, a gate electrode 116 is formed on the insulation layer 114. The gate electrode 116 is formed to cross over the cathode electrode 112 and the focus electrode 113. More specifically, the gate electrode 116 is formed by depositing a conductive material, such as a chrome (Cr)-based gate electrode material, on the insulation layer 114 to a predetermined thickness through a sputtering method and patterning the conductive material into a predetermined shape. Accordingly, the gate electrode 116 is formed on the top surface of the insulation layer 114, under which the cathode electrode 112 and the focus electrode 113 are located. During the formation of the gate electrode 116, an electron extractor 116*a*, which extracts electrons from the field emitter 120, is formed at the gate electrode 116 to be asymmetric with respect to the field emitter 120. In other words, the electron extractor 116*a* is formed over the cathode electrode 112 to extend from one side of the gate electrode 116, as shown in FIG. 5. The gate electrode 116, at which a plurality of electron extractors 116*a* are formed, is formed in a comb shape.

Figure 9D:
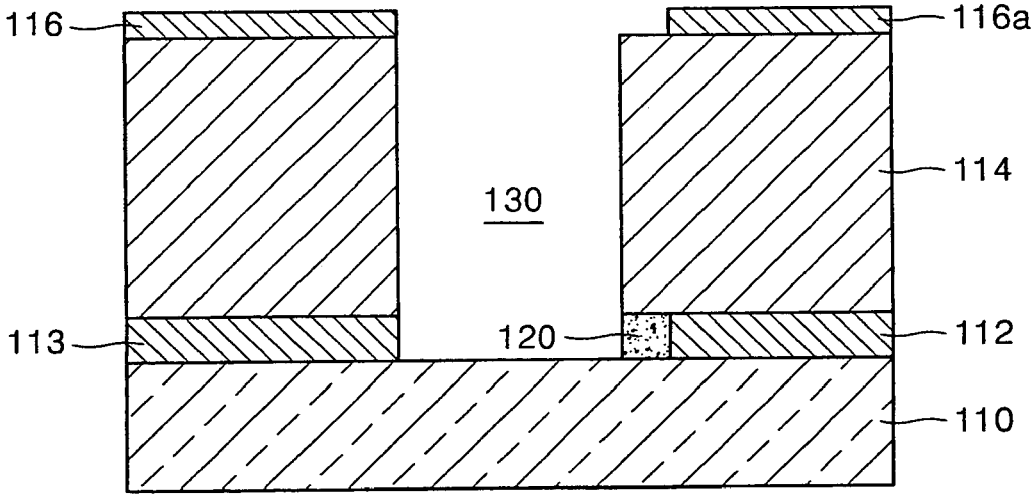

Referring to FIG. 9D, the insulation layer 114 exposed by the gate electrode 116 is dry-etched or wet-etched, thus forming an emitter hole 130, through which the cathode electrode 112, the focus electrode 113, and the field emitter 120 are partially exposed. During this etching process, the gate electrode 116 can be used as an etching mask.

In the meantime, in the case of manufacturing an FED, in which the field emitter 120" protrudes from one sidewall of the emitter hole 130, as shown in FIG. 8, the field emitter 120" may be formed at a final state of the process of manufacturing the FED. A method of manufacturing an FED of FIG. 8 is very similar to the method of manufacturing an FED illustrated in FIGS. 9A through 9D, and thus only differences therebetween will now be described in greater detail. An electrode material is coated on a substrate 110 and then patterned, thus forming a cathode electrode 112 and a focus electrode 113 on the same level with each other on the substrate 110. An insulation layer 114 is formed on the substrate 110, on which the cathode electrode 112 and the focus electrode 113 are formed. Thereafter, a gate electrode material is coated on the insulation layer 114 and then patterned, thus forming a gate electrode 116 on the insulation layer 114, under which the cathode electrode 112 and the focus electrode 113 are located. Thereafter, the insulation layer 114 exposed by the gate electrode 116 is etched, thus partially exposing the cathode electrode 112 and the focus electrode. Finally, the field emitter 120" is formed at one side of the cathode electrode 112 exposed to face the focus electrode 113 by the emitter hole 130. The field emitter 120" may be formed by depositing carbon nanotubes at the one side of the cathode electrode 112 and growing the carbon nanotubes. In this case, the electron extractors 116*a*, which extracts electrons from the field emitter 120", is formed at the gate electrode 116 to be asymmetric with respect to the field emitter 120".

Figure 10A:
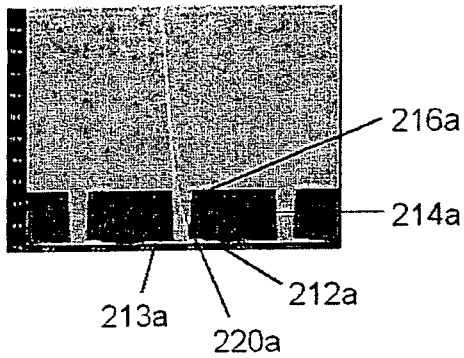
FIGS. 10A through 10C, 11A, and 11B are diagrams illustrating the structures of FEDs according to the present invention, which are subjected to a computer simulation experiment.
Figure 10B:
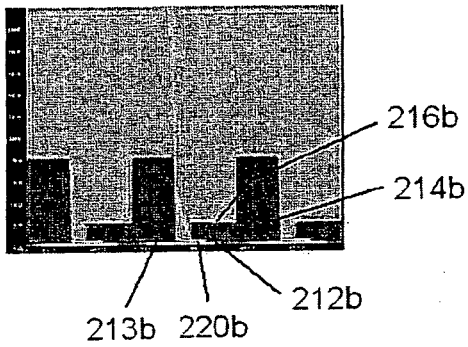
Figure 10C:
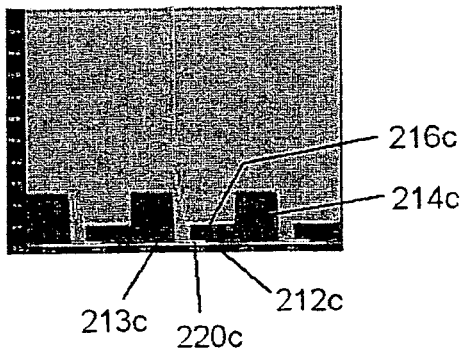

Computer simulation results of field emission displays according to the present invention will now be discussed. FIGS. 10A through 10C are diagrams illustrating the structures of field emission displays according to the present invention, which are subjected to a computer simulation experiment. Referring to FIGS. 10A through 10C, reference numerals 212*a*, 212*b*, and 212*c* represent cathode electrodes, reference numerals 213*a*, 213*b*, and 213*c* represent focus electrodes, reference numerals 216*a*, 216*b*, and 216*c* represent gate electrodes, and reference numerals 220*a*, 220*b*, and 220*c* represent field emitters. An insulation layer 214*a* of FIG. 10A and an insulation layer 214*c* of FIG. 10C each have a height of 5 μm, and an insulation layer 214*b* of FIG. 10B has a height of 8 μm.

Figure 11A:
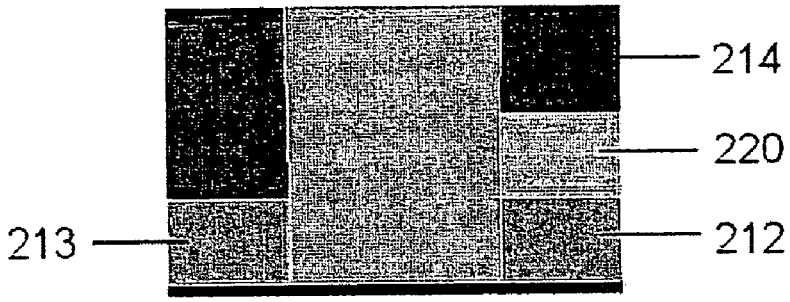
Figure 11B:
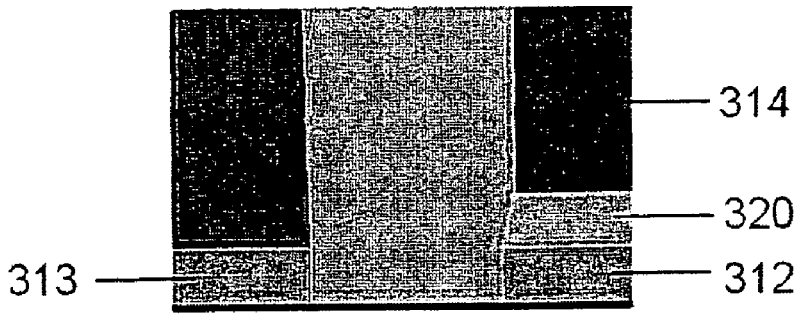
Figure 12A:
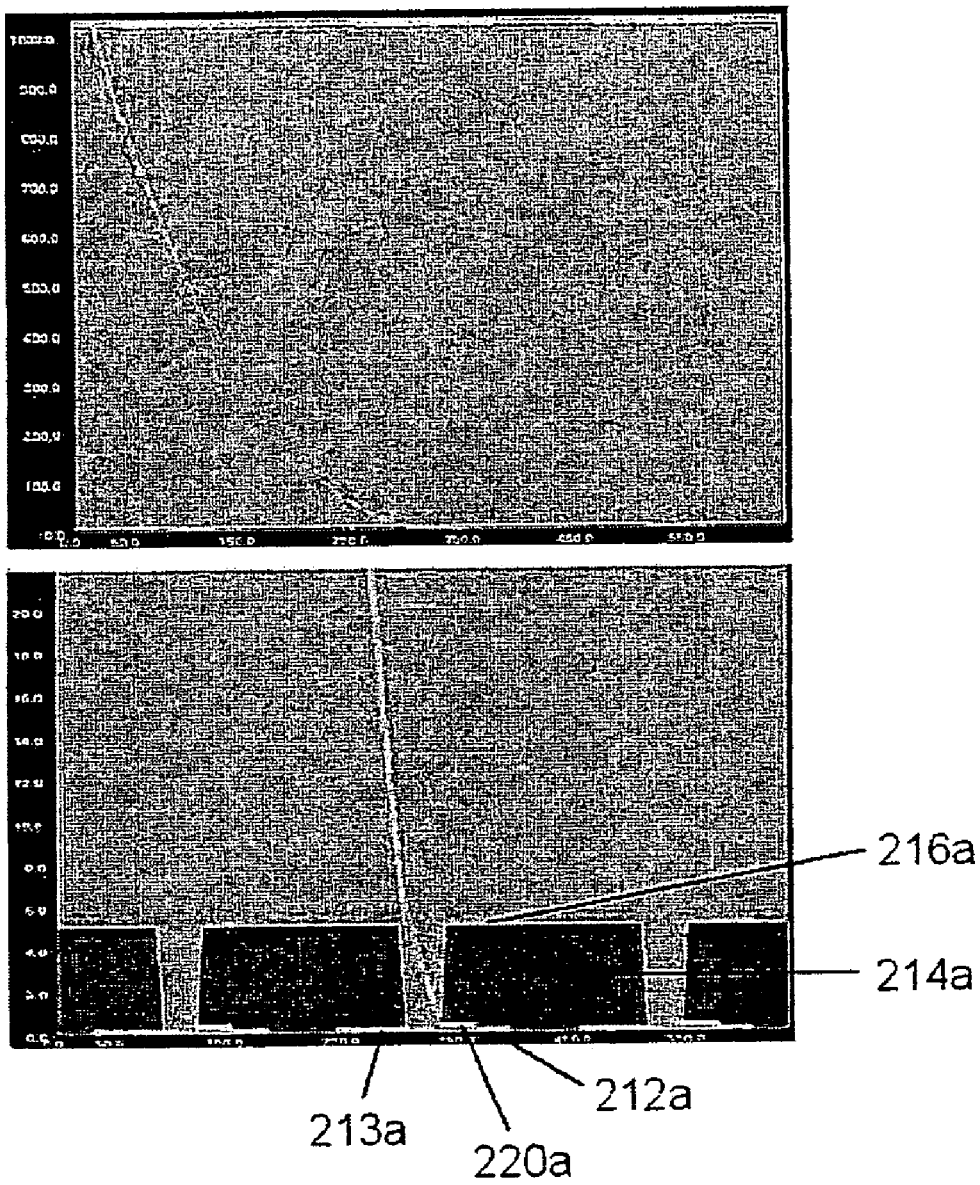
FIGS. 12A, 12B, 13A, 13B, 14A, 14B, 15, and 16 are diagrams illustrating computer simulation results of the FEDs illustrated in FIGS. 10A through 10C, 11A, and 11B.
Figure 12B:
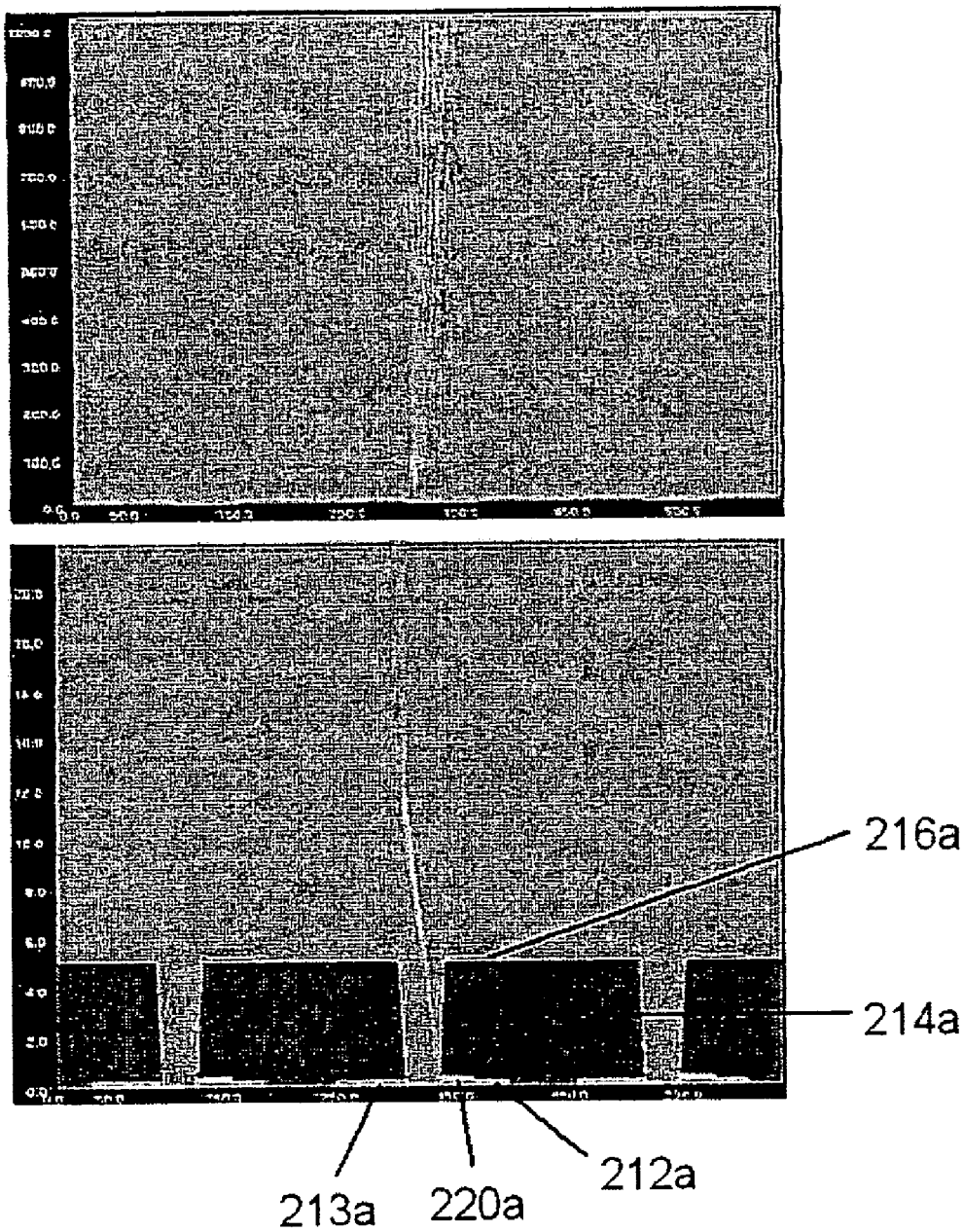
Figure 13A:
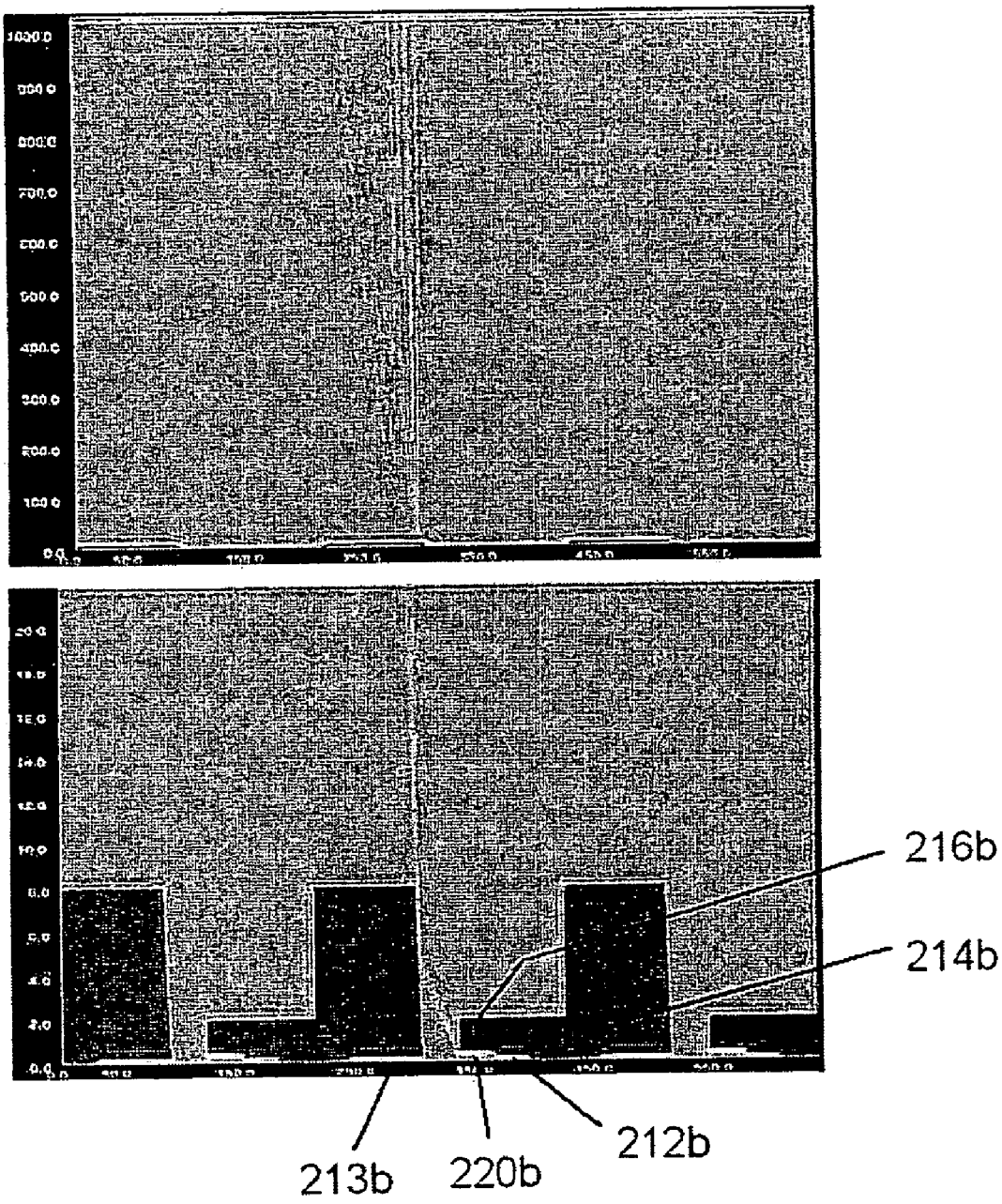
Figure 13B:
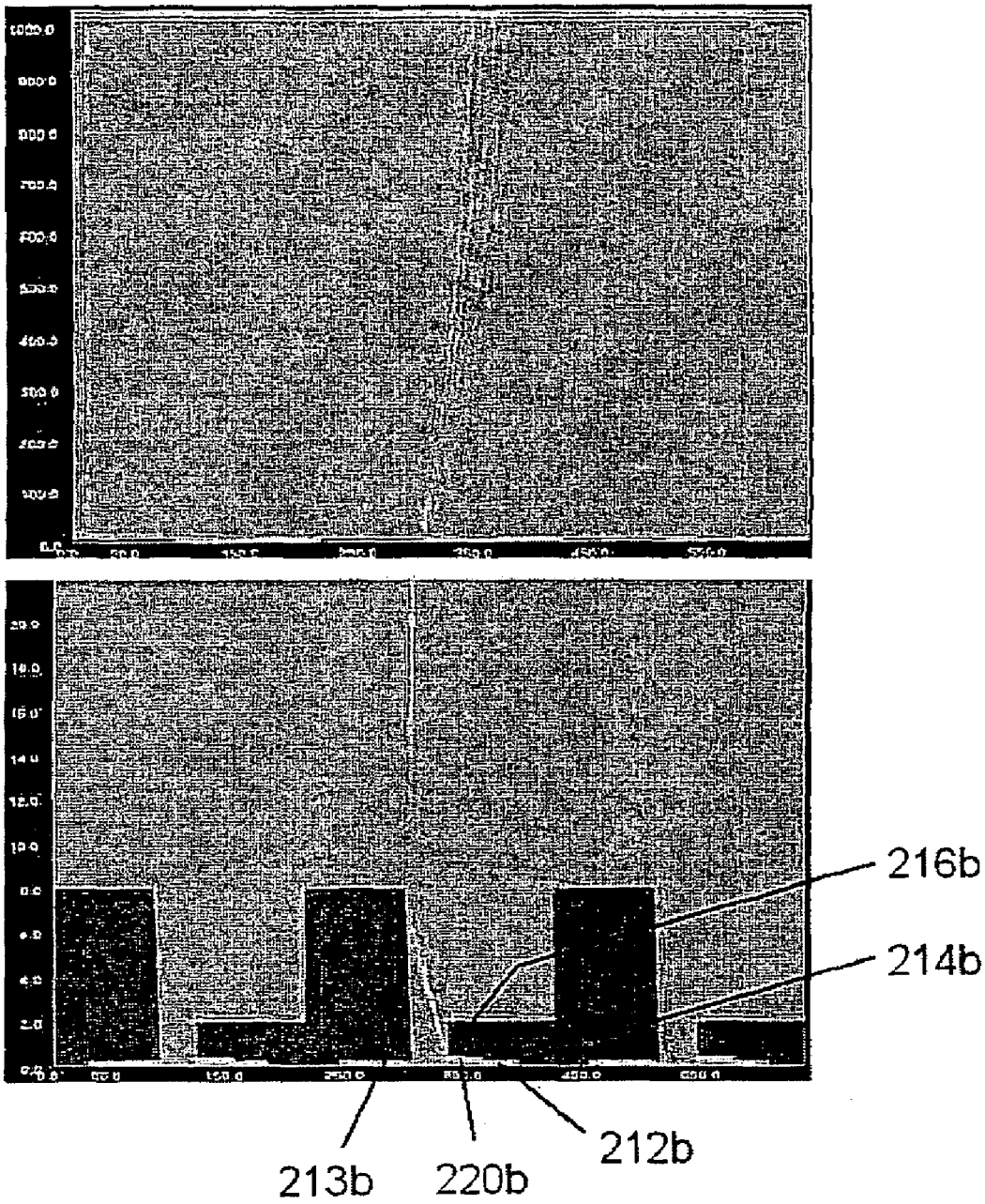
Figure 14A:
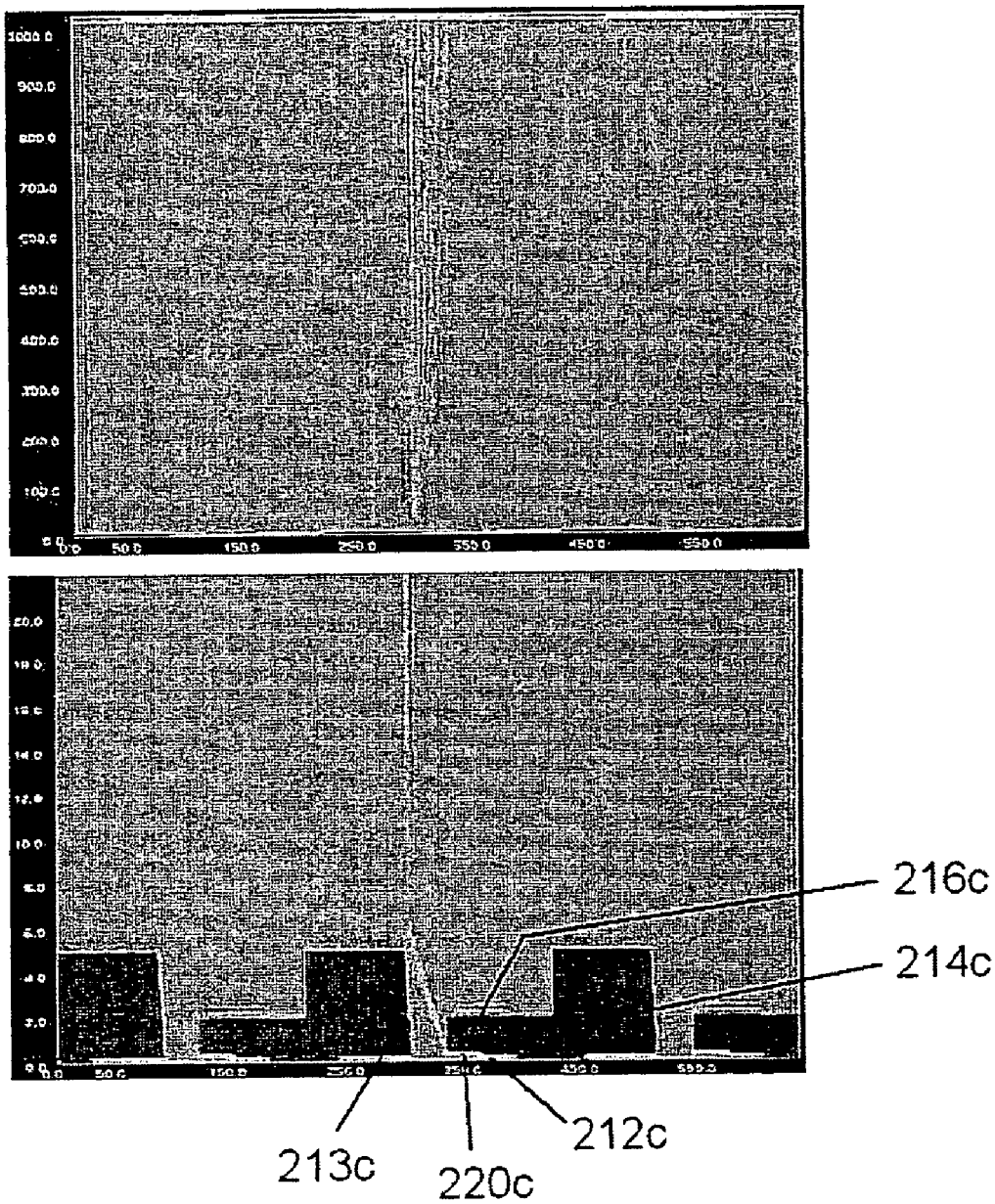
Figure 14B:
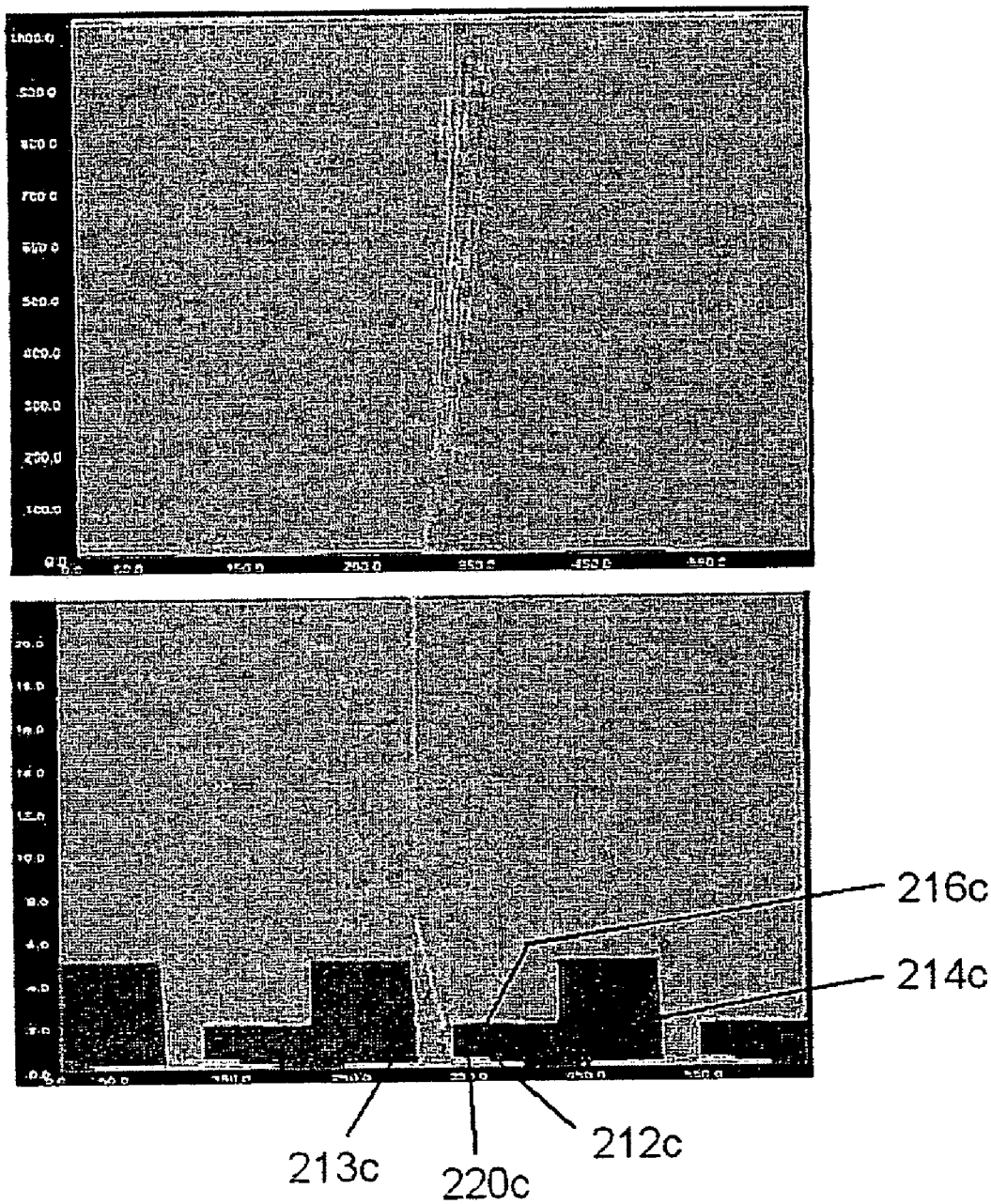
Figure 15:
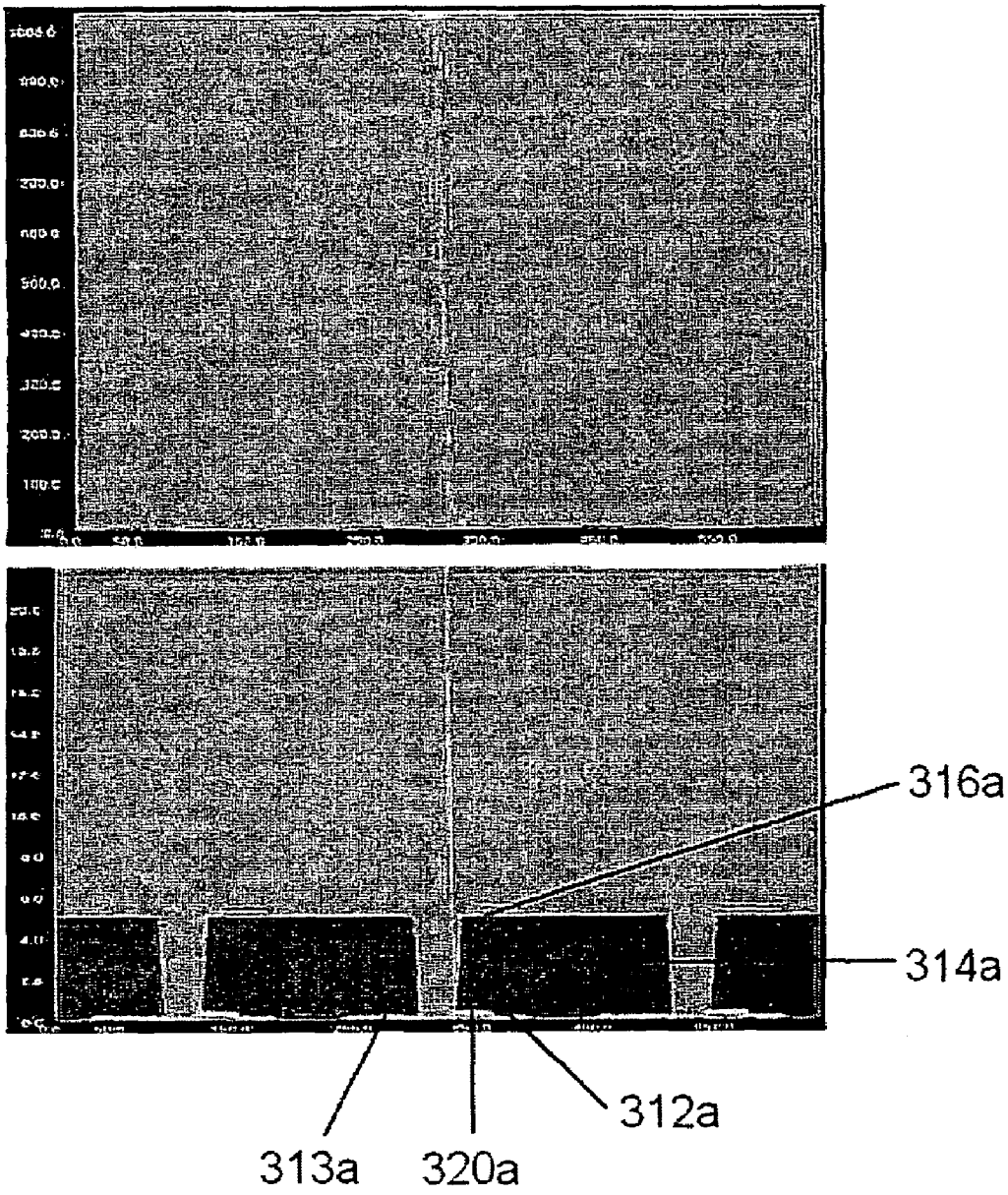
Figure 16:
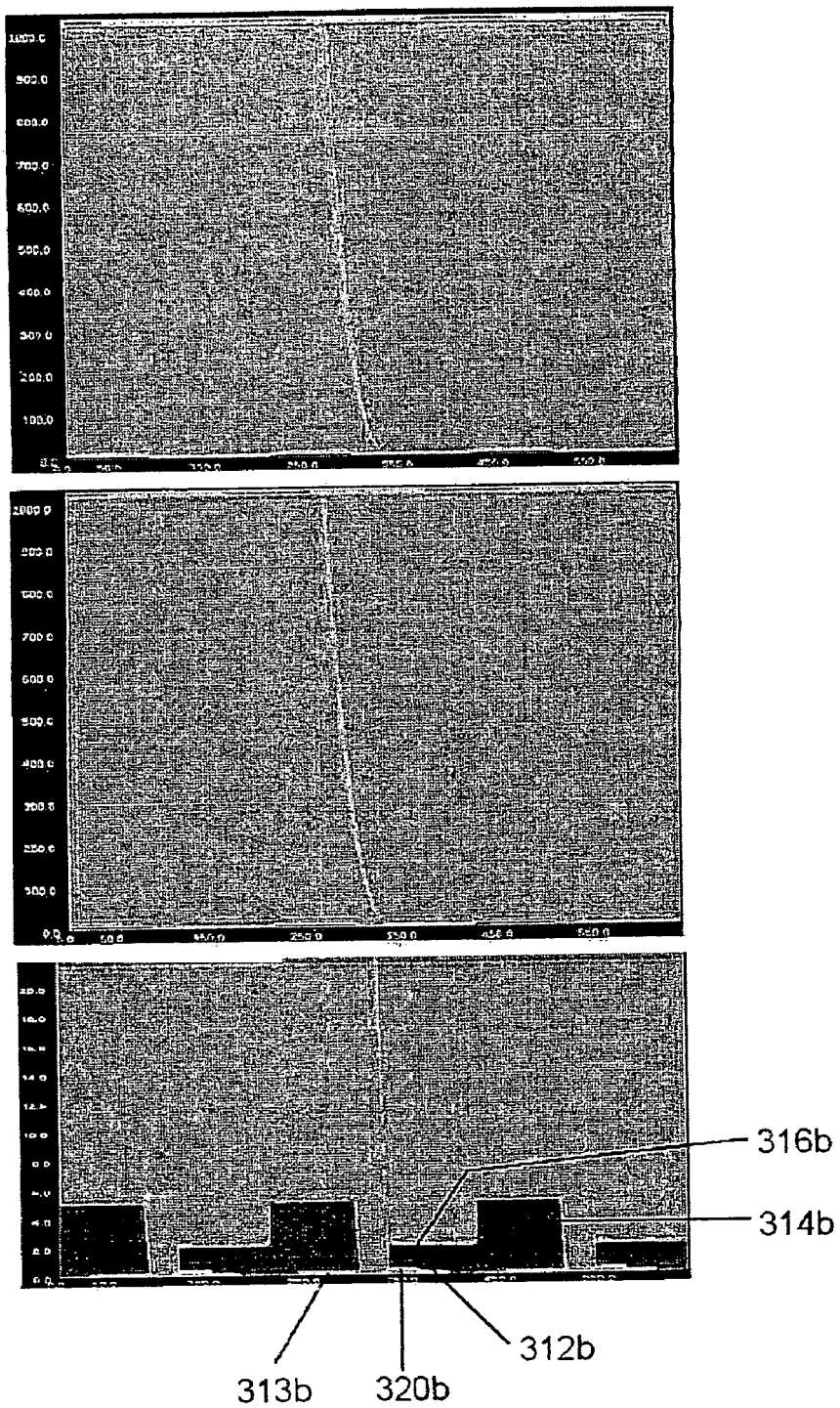

FIGS. 12A, 12B, 13A, 13B, 14A, 14B, 15, and 16 are diagrams illustrating electron beam trajectory simulation results of the FEDs illustrated in FIGS. 10A through 10C, 11A, and 11B. More specifically, FIGS. 12A and 12B illustrate simulation results of the FED illustrated in FIG. 10A, FIGS. 13A and 13B illustrate simulation results of the FED illustrated in FIG. 10B, and FIGS. 14A and 14B illustrate simulation results of the FED illustrated in FIG. 10C. FIG. 11A illustrates the structure of a predetermined portion of each of the FEDs of FIGS. 10A through 10C, from which electrons are emitted. Referring to FIG. 11A, reference numerals 212, 213, 214, and 220 represent a cathode electrode, a focus electrode, an insulation layer, and a field emitter, respectively. FIGS. 15 and 16 illustrate simulation results of the FEDs of FIGS. 10A and 10C, respectively, when the predetermined portion of each of the corresponding FEDs has a structure illustrated in FIG. 11B. Referring to FIG. 11B, reference numerals 312, 313, 314, and 320 represent a cathode electrode, a focus electrode, an insulation layer, and a field emitter, respectively.

FIG. 12A illustrates an electron beam trajectory simulation result of the FED of FIG. 10A when a voltage of −50 V is applied to the cathode electrode 212*a*, a voltage of 50 V to an anode electrode, and a voltage of 50 V to the focus electrode 213*a*, and FIG. 12B illustrates an electron beam trajectory simulation result of the FED of FIG. 10A when a voltage of −20 V is applied to the cathode electrode 212*a*, a voltage of 70 V to the anode electrode, and a voltage of −60 V to the focus electrode 213*a*. In FIG. 12B, the tendency of an electron beam to go straight from a field emitter 220*a* is considerably improved, compared to FIG. 12A, so that the electron beam can arrive at a place almost vertical to the anode electrode.

FIG. 13A illustrates an electron beam trajectory simulation result of the FED of FIG. 10B when a voltage of −20 V is applied to the cathode electrode 212*b*, a voltage of 70 V to an anode electrode, and a voltage of 0 V to the focus electrode 213*b*, and FIG. 13B illustrates an electron beam trajectory simulation result of the FED of FIG. 10B when a voltage of −20 V is applied to the cathode electrode 212*b*, a voltage of 70 V to the anode electrode, and a voltage of −20 V to the focus electrode 213*b*. The arrival point of an electron beam of FIG. 13B leans rightward, compared to the arrival point of an electron beam of FIG. 13A, due to a variation of −20 V in the voltage applied to the focus electrode 213*b*.

FIG. 14A illustrates an electron beam trajectory simulation result of the FED of FIG. 10C when a voltage of −20 V is applied to the cathode electrode 212*c*, a voltage of 70 V to an anode electrode, and a voltage of −20 V to the focus electrode 213*c*, and FIG. 14B illustrates an electron beam trajectory simulation result of the FED of FIG. 10C when a voltage of −20 V is applied to the cathode electrode 212*c*, a voltage of 70 V to the anode electrode, and a voltage of −30 V to the focus electrode 213*c*. The arrival point of an electron beam of FIG. 14B leans rightward, compared to the arrival point of an electron beam of FIG. 14A, due to a variation of −10 V in the voltage applied to the focus electrode 213*c*.

FIG. 15 illustrates an electron beam trajectory simulation result of an FED when a voltage of −20 V is applied to a cathode electrode 312*a*, a voltage of 70 V to an anode electrode, and a voltage of −60 V to a focus electrode 313*a*. Referring to FIG. 15, an electron beam goes straight ahead from a field emitter.

The middle and lower views of FIG. 16 illustrate an electron beam trajectory simulation result of an FED when a voltage of −20 V is applied to a cathode electrode 312*b*, a voltage of 50 V to an anode electrode, and a voltage of −30 V to a focus electrode 313*b*, and the upper view of FIG. 16 illustrates an electron beam trajectory simulation result of the FED when a voltage of −10 V is applied to the cathode electrode 312*b*, a voltage of 50 V to the anode electrode, and a voltage of −30 V to the focus electrode 313*b*. Electron beams of the three views of FIG. 16 arrive at almost the same place regardless of the level of voltage applied to the cathode electrode 312*b*.

In short, according to the present invention, it is possible to freely control an arrival point of an electron beam emitted from an FED by appropriately adjusting voltage applied to a focus electrode of the FED.

As described above, the present invention has the following advantages. First, it is possible to freely control the trajectory of an electron beam by adjusting voltage applied to a focus electrode. Second, it is possible to simplify the structure of an FED by forming a cathode electrode and the focus electrode on the same level with each other on a substrate. Third, it is possible to simplify a process of manufacturing the FED by reducing the number of film coating processes and optical etching processes. Fourth, it is possible to increase the amount of current emitted from the FED by applying a positive level of voltage to the focus electrode.

While the present invention has been particularly shown and described with reference to exemplary embodiments thereof, it will be understood by those of ordinary skill in the art that various changes in form and details maybe made therein without departing from the spirit and scope of the present invention as defined by the following claims.

What is claimed is:

1. A field emission display (FED), comprising:

a substrate;

a cathode electrode and a focus electrode arranged on the same level on the substrate;

an insulation layer arranged on the cathode electrode and the focus electrode such that the cathode electrode and the focus electrode are partially exposed through the insulation layer;

a field emitter arranged at a portion of the cathode electrode exposed by the insulation layer; and a gate electrode arranged on the insulation layer, wherein the field emitter is arranged on a side of the cathode electrode that faces a portion of the focus electrode exposed by the insulation layer.

2. The FED of claim 1, the cathode electrode and the focus electrode are made of the same material.

3. The FED of claim 1, the cathode electrode and the focus electrode are simultaneously formed on the substrate.

4. The FED of claim 1, a plurality of cathode electrodes and a plurality of focus electrodes are arranged in an alternate manner on the substrate.

5. The FED of claim 4, the plurality of cathode electrodes and the plurality of focus electrodes being arranged as stripes.

6. The FED of claim 1, the field emitter being arranged on the same level as the cathode electrode.

7. The FED of claim 1, the field emitter being arranged at one side of the cathode electrode.

8. The FED of claim 1, the field emitter comprising a material selected from the group consisting of carbon nanotubes, graphite nanoparticles, nano diamond, boron nitride (BN), diamond-like carbon (DLC), cesium oxide (CsO), gold (Au), silicon (Si), platinum (Pt), iron (Fe), nickel (Ni), copper (Cu) and magnesium oxide (MgO).

9. The FED of claim 1, the gate electrode being arranged to cross over the cathode electrode and the focus electrode.

10. The FED of claim 9, further comprising an electron extractor adapted to extract electrons from the field emitter and arranged at the gate electrode to be asymmetric with respect to the field emitter.

11. The FED of claim 10, the electron extractor is arranged extending from one side of the gate electrode.

12. The FED of claim 10, the electron extractor is arranged over the cathode electrode.

13. The FED of claim 1, further comprising an anode with fluorescent material arranged thereon, the anode being arranged opposite to the substrate having the cathode electrode and focus electrode thereon, the gate electrode being arranged between the anode and each of the cathode and focus electrodes.

14. The FED of claim 1, the gate electrode adapted to emit electrons from the field emitter and the focus electrode being adapted to adjust a trajectory of an electron beam emitted from the field emitter and adapted to focus the electron beam.

15. The FED of claim 1, the focus electrode being applied a different voltage than the gate electrode.

* * * * *